US011571901B2

(12) United States Patent
Hirabayashi

(10) Patent No.: US 11,571,901 B2
(45) Date of Patent: Feb. 7, 2023

(54) PRINTING DEVICE AND PRINTING SYSTEM

(71) Applicant: SEIKO EPSON CORPORATION, Tokyo (JP)

(72) Inventor: Tomoyoshi Hirabayashi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/543,384

(22) Filed: Dec. 6, 2021

(65) Prior Publication Data

US 2022/0176701 A1 Jun. 9, 2022

(30) Foreign Application Priority Data

Dec. 7, 2020 (JP) ..... JP2020-202475

(51) Int. Cl.
*B41J 2/165* (2006.01)

(52) U.S. Cl.
CPC ..... *B41J 2/16523* (2013.01)

(58) Field of Classification Search
CPC ..... B41J 2/17556; B41J 2/16532; B41J 2002/16513
See application file for complete search history.

(56) References Cited

U.S. PATENT DOCUMENTS 5,223,388 A 6/1993 Saitou
2017/0090830 A1* 3/2017 Tomono ..... G06F 3/1219

FOREIGN PATENT DOCUMENTS

EP 3916537 A1 * 12/2021 ..... H04N 1/00244
JP 2010-247485 A 11/2010
JP 5223388 B2 6/2013

* cited by examiner

*Primary Examiner* — Sharon Polk
(74) *Attorney, Agent, or Firm* — Oliff PLC

(57) ABSTRACT

A printing device to which a predetermined flat-rate usage fee is applied regardless of the number of times a cartridge is replaced includes an ejection head having a nozzle capable of ejecting a liquid stored in each of a plurality of cartridges, and a controller, wherein the controller includes a cleaning execution unit that executes a cleaning process and wherein the cleaning process includes a determination process of determining the presence or absence of a specific cartridge, among a plurality of cartridges, whose liquid remaining amount is equal to or greater than a reference remaining amount before performing the cleaning operation, and whose liquid remaining amount is expected to be less than the reference remaining amount when the cleaning operation is executed, and a setting process of setting the specific cartridge as a cartridge to be replaced before executing the cleaning operation.

7 Claims, 6 Drawing Sheets

PRINTING DEVICE AND PRINTING SYSTEM

The present application is based on, and claims priority from JP Application Serial Number 2020-202475, filed Dec. 7, 2020, the disclosure of which is hereby incorporated by reference herein in its entirety.

BACKGROUND

1. Technical Field

The present disclosure relates to a printing device and a printing system.

2. Related Art

In the related art, there is known a printing device that includes a plurality of cartridges that can be individually replaced, and after the cartridges are replaced, performs cleaning by sucking ink from all the corresponding nozzles of the plurality of cartridges. JP-A-2010-247485 discloses a printing device that selects, as a cartridge to be replaced, a cartridge whose remaining amount of ink is expected to fall below a predetermined threshold value when cleaning is performed as well as a cartridge whose remaining amount of ink falls below a predetermined threshold value in order to avoid repeated replacement of cartridges in a short time.

There is a service that provides use of a printing device by receiving payment of the usage amount according to a predetermined contract plan. In this service, the provision of a service related to cartridge replacement in a printing device having the above specification has not been sufficiently examined.

SUMMARY

According to an aspect of the present disclosure, a printing device is provided. The printing device includes a cartridge mounting unit that allows a plurality of cartridges to be attached and detached, an ejection head including a plurality of nozzles configured to eject a liquid stored in each of the plurality of cartridges, and a controller, wherein a predetermined flat-rate usage fee is applied to the printing device regardless of the number of times the cartridges are replaced, wherein the controller includes a cleaning execution unit that executes a cleaning process including a cleaning operation of sucking and flowing out the liquid from the nozzles for all of the plurality of cartridges when a predetermined cleaning condition is satisfied and a remaining amount acquisition unit that acquires a liquid remaining amount of each of the plurality of cartridges, and wherein the cleaning process includes a determination process of determining presence or absence of a specific cartridge, among the plurality of cartridges, in which the liquid remaining amount that is equal to or greater than a predetermined reference remaining amount, and the liquid remaining amount is expected to be less than the reference remaining amount when the cleaning operation is executed, the determination process being executed before the cleaning operation is executed, and a setting process of setting the specific cartridge as a cartridge to be replaced before executing the cleaning operation when it is determined by the determination process that the specific cartridge is present.

According to another aspect of the present disclosure, a printing system is provided. The printing system includes the printing device of the first aspect and a server device that communicates with the printing device, wherein the printing device further includes a communication unit that communicates with the server device, and wherein the communication unit transmits, to the server device, replacement information indicating that the specific cartridge is set as a cartridge to be replaced when the cleaning execution unit sets the specific cartridge as a cartridge to be replaced.

DESCRIPTION OF EXEMPLARY EMBODIMENTS

A. First Embodiment

Figure 1:
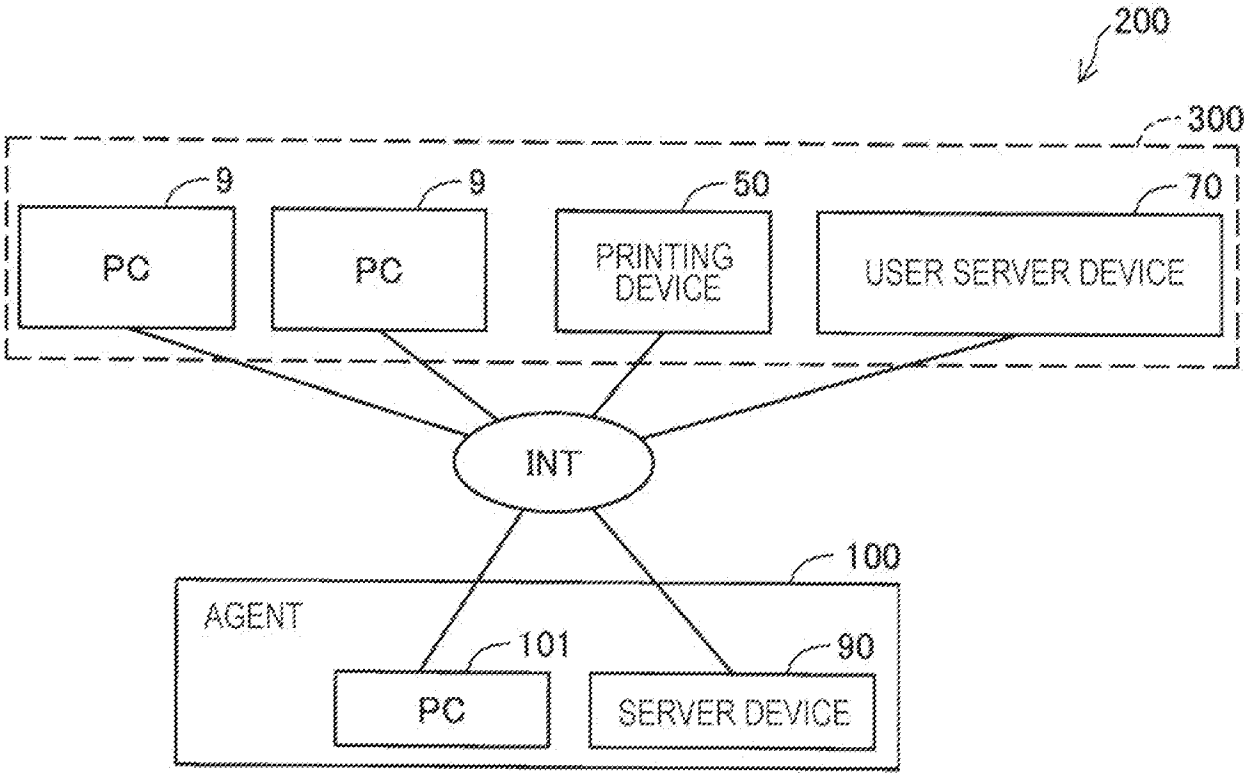
FIG. 1 is a diagram showing a delivery system of the present embodiment.

FIG. 1 is a diagram showing a delivery system 200 of the present embodiment. The delivery system 200 includes a printing system 300, a server device 90, and a personal computer (PC) 101 as an information processing device. The server device 90 and the PC 101 are provided in, for example, an agent 100. In the present embodiment, the printing system 300 includes a printing device 50, a plurality of personal computers (PCs) 9, and a user server device 70. The printing system 300 is provided with a service that allows the printing device 50 to be used by paying a usage amount according to a predetermined contract plan. A print driver that controls the printing device 50 is stored in the PC 9. In the present embodiment, the printing system 300 is composed of one printing device 50 and two PCs 9, but the number of the printing devices 50 and the PCs 9 is not limited to this. Further, when the printing system 300 includes a plurality of printing devices 50, the models may be the same or different from each other. The user server device 70 manages the printing device 50 according to the contract plan.

The agent 100 concludes a specific contract plan with the user of the printing system 300. In the contract plan, for example, a predetermined flat-rate usage fee is applied regardless of the number of times a cartridge 20 is replaced, which will be described later. For example, while the monthly usage fee is fixed, the user can replace the cartridge used for the printing device 50, which is the target of the contract plan, as many times as necessary. The server device 90 manages the delivery process of the cartridge 20, which will be described later. In the present embodiment, the server device 90 is owned by the agent 100, but the server device 90 may be owned by a person who is different from the agent 100 and in charge of collecting and delivering the cartridge.

In the present embodiment, the PC 9, the printing device 50, and the user server device 70 of the printing system 300 and the PC 101 and the server device 90 of the agent 100 are communicably connected to each other via the Internet. The communication mode is not limited to this, and for example, the communication network between the PC 9 and the printing device 50 of the printing system 300 and the user server device 70, and the communication network between the user server device 70, and the PC 101 and the server device 90 of the agent 100 may be different with each other.

When a specific contract plan is concluded between the agent 100 and the printing system 300, a control program for the printing device 50 according to the contract plan is transmitted from the PC 101 to the user server device 70, for example. The control program is applied to the printing device 50 using the user server device 70. As a result, the printing device 50 operates according to the contract plan. In another embodiment, when a specific contract plan is concluded, the agent 100 may install a control program according to the contract plan on the printing device 50. Further, when the cartridge mounted on the printing device 50 is replaced, information is transmitted from the printing device 50 to the server device 90.

Figure 2:
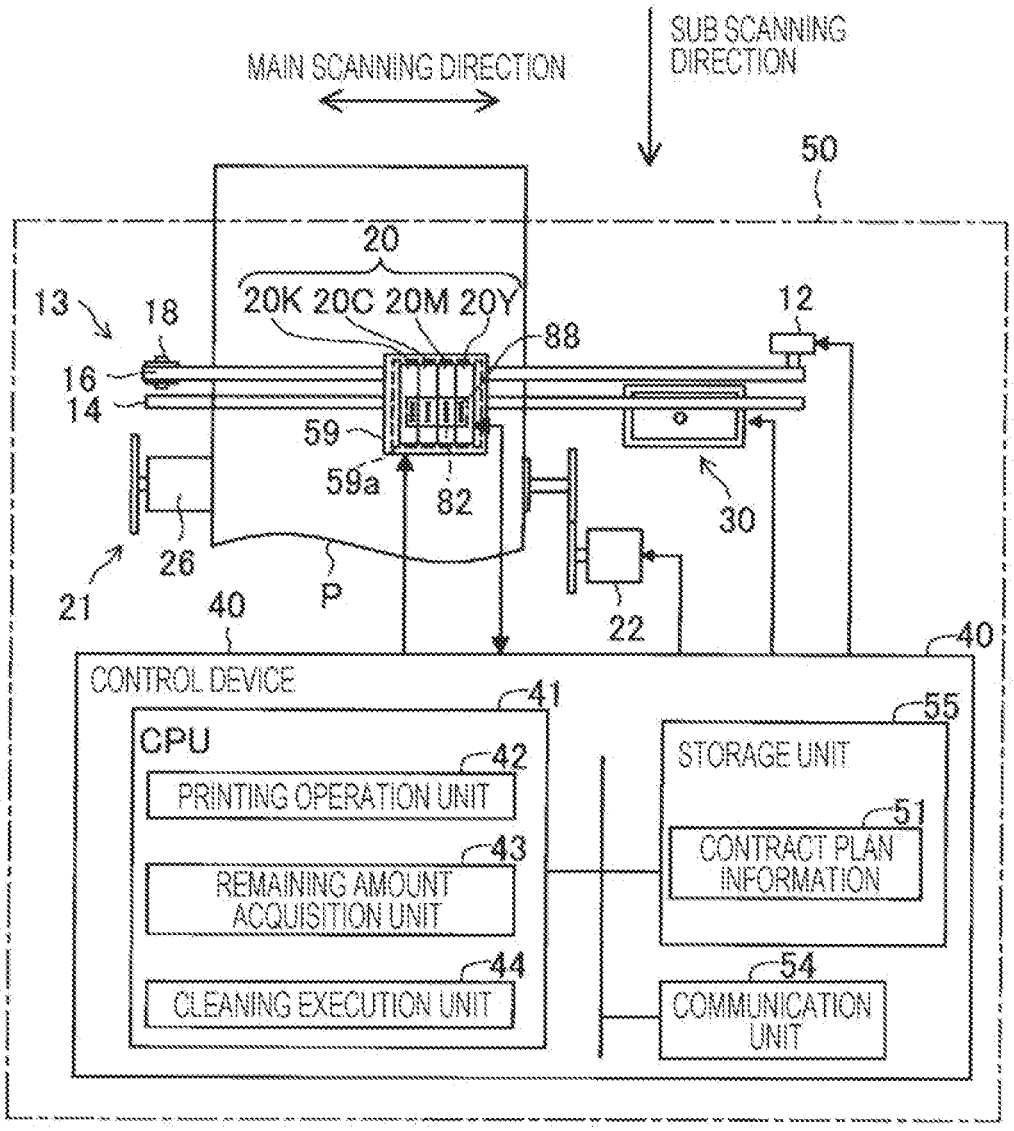
FIG. 2 is a diagram showing a configuration of a printing device.

FIG. 2 is a diagram showing the configuration of the printing device 50. A specific contract plan that imposes a predetermined flat-rate usage fee on the user regardless of the number of times the cartridge 20 is replaced, which will be described later, is applied to the printing device 50. The printing device 50 is an ink jet printer capable of color printing and ejecting ink as a liquid. The printing device 50 includes a control device 40 that controls the operation of the printing device 50, a carriage 59, a drive mechanism 13, a paper feed mechanism 21, and a suction mechanism 30.

The carriage 59 includes a cartridge mounting unit 59*a*. A plurality of cartridges 20 can be detachably mounted on the cartridge mounting unit 59*a*. Four types of cartridges 20 in which cyan (C), magenta (M), yellow (Y), and black (K) inks are stored are mounted on the cartridge mounting unit 59*a* of the present embodiment. When the cartridge 20 is mounted on the cartridge mounting unit 59*a*, a signal indicating that the cartridge 20 is mounted is input to a CPU 41. On the side, of the carriage 59, facing a print medium P, an ejection head 82 that discharges the ink in the cartridge 20 mounted on the carriage 59 toward the outside is attached. The ejection head 82 includes a plurality of nozzles 88 corresponding to each of the four types of cartridges 20. A printed image is formed on the print medium P by ejecting ink from the plurality of nozzles 88. When the type of the cartridge 20 is distinguished by the type of the stored ink, the cartridge 20 is referred to as a cartridge 20C, 20M, 20Y, 20K by adding a reference numeral indicating each color.

The drive mechanism 13 is a mechanism that moves the carriage 59 in the main scanning direction. The drive mechanism 13 includes a carriage motor 12, a pulley 18, a drive belt 16, and a sliding shaft 14. The sliding shaft 14 slidably holds the carriage 59 fixed to the drive belt 16. The rotation of the carriage motor 12 is transmitted to the carriage 59 via the drive belt 16. As a result, the carriage 59 reciprocates along the sliding shaft 14 in the main scanning direction. The paper feed mechanism 21 includes a paper feed roller 26 and a paper feed motor 22. The rotation of the paper feed roller causes the print medium P to be transported in the sub scanning direction.

The suction mechanism 30 is used for cleaning the inside of the nozzles by sucking ink from the plurality of nozzles 88. Details of the suction mechanism 30 will be described later.

The control device 40 includes the CPU 41 as a controller, a storage unit 55 composed of a ROM and a RAM, and a communication unit 54. The storage unit 55 stores contract plan information 51 indicating a specific contract plan applied to the printing device 50. The communication unit 54 performs data communication with the outside by wire or wireless. The CPU 41 controls the operation of the printing device 50. The CPU 41 functions as a printing operation unit 42, a remaining amount acquisition unit 43, and a cleaning execution unit 44 by executing various control programs stored in the storage unit 55.

The printing operation unit 42 receives a print job from the outside such as a computer 9, and controls the print operation of the printing device 50 according to the print job. For example, the printing operation unit 42 controls the operations of the drive mechanism 13, the paper feed mechanism 21, and the ejection head 82. Specifically, the printing operation unit 42 converts the RGB image data of the print job received from the outside into CMYK print data, and executes monochrome printing or color printing using the print data.

The remaining amount acquisition unit 43 acquires the liquid remaining amount, which is the remaining amount of ink as the liquid of each of the cartridges 20. A remaining amount sensor (not shown) is attached to the cartridge 20, and when the liquid remaining amount, which is the remaining amount of ink, is equal to or less than a predetermined sensor reference value, a detection signal is input from the remaining amount sensor to the CPU 41. Examples of the remaining amount sensor include a sensor that optically detects the remaining amount using a prism or the like, a piezoelectric vibration element that outputs residual vibration as a detection signal, and the like. When the detection signal is input from the remaining amount sensor and it is determined that the liquid remaining amount is equal to or less than the predetermined sensor reference value, the remaining amount acquisition unit 43 executes the following process. That is, the remaining amount acquisition unit 43 counts the number of times the ink is ejected from the nozzles 88 of the ejection head 82 corresponding to each color, and multiplies the predetermined amount of ink per ejection by the number of times of ejection to estimate the ink consumption by the so-called dot count method. Then, the remaining amount acquisition unit 43 subtracts the ink consumption estimated from the sensor reference value to acquire a liquid remaining amount Ar of the cartridge 20.

The cleaning execution unit 44 executes the end process and the cleaning reception process, which will be described later. The end process and the cleaning reception process include a first cleaning process as a cleaning process described later using the suction mechanism 30. In addition, the first cleaning process includes a cleaning operation. The cleaning operation is an operation in which a suction pump 34 is driven with a nozzle face 84 covered with a cap member 31 to forcibly discharge the ink from each nozzle 88 of the ejection head 82 by suction. That is, the cleaning operation is an operation of sucking and flowing out the liquid from the nozzle 88 for all of the plurality of cartridges 20C, 20M, 20Y, and 20K mounted on the cartridge mounting unit 59*a*. The cleaning operation will be described with reference to FIG. 3.

Figure 3:
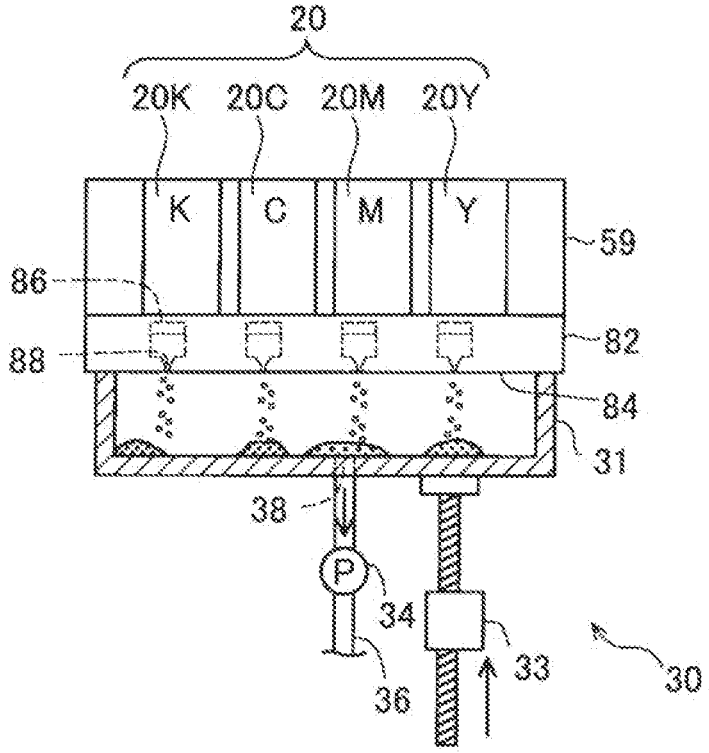
FIG. 3 is a diagram for explaining an ejection head and a suction mechanism.

FIG. 3 is a diagram for explaining the ejection head 82 and the suction mechanism 30. The suction mechanism 30 is used to cover the nozzles 88 of the ejection head 82 and to suck the ink from the nozzle 88. The ejection head 82 includes the plurality of nozzles 88 formed on the nozzle face 84, and piezoelectric elements 86 as a pressure generating mechanism. The plurality of nozzles 88 has a nozzle row communicating with the cartridge 20C, a nozzle row communicating with the cartridge 20M, a nozzle row communicating with the cartridge 20Y, and a nozzle row communicating with the cartridge 20K. The plurality of nozzles 88 can eject the ink stored in each of the plurality of cartridges 20. That is, when the piezoelectric element 86 is driven by a command from the CPU 41, the nozzle 88 ejects the ink.

The suction mechanism 30 includes the cap member 31, an elevating mechanism 33, the suction pump 34, and a discharge flow path 36. The cap member 31 has a recessed shape and can cover the nozzle face 84. A closed space is formed by the cap member 31 covering the nozzle face 84. An opening 38 is formed at the bottom of the cap member 31. The opening 38 is coupled to the discharge flow path 36 formed of a tube. The ink flowing through the discharge flow path 36 is stored in a waste liquid tank (not shown) of the printing device 50. The suction pump 34 is disposed in the middle of the discharge flow path 36. The suction pump 34 is driven by a command from the CPU 41. The elevating mechanism 33 elevates and lowers the cap member 31. The elevating mechanism 33 is driven by a command from the CPU 41. When the printing operation is not performed, the carriage 59 is located at the home position located directly above the suction mechanism 30.

The cleaning operation is executed, for example, when the cartridge 20 is replaced or when an instruction to execute the cleaning operation is received. After the cartridge 20 is replaced, air bubbles may be generated in the ink supply path from the cartridge 20 to the nozzle 88 and in the nozzle 88. Therefore, by executing the cleaning operation, air bubbles can be removed and good print quality can be maintained. Further, when the ink at the tip of the nozzle 88 is thickened, the ink may not be sufficiently ejected from the nozzle 88 at the time of printing, and the printing may not be performed according to the printing data. In this case, for example, the user instructs the cleaning operation of the printing device 50 via the PC 9. By performing the cleaning operation, the thickened ink on the tip side of the nozzle 88 is discharged, and good print quality can be maintained.

Figure 4:
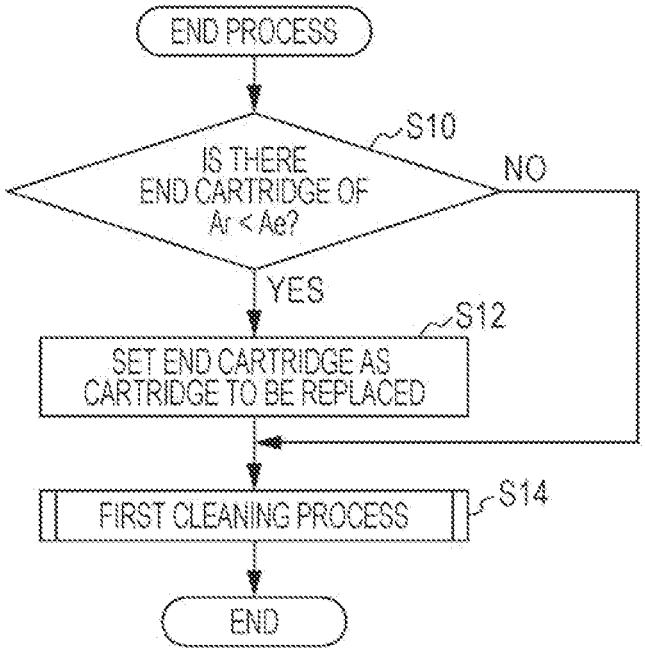
FIG. 4 is a flowchart of an end process.
Figure 5:
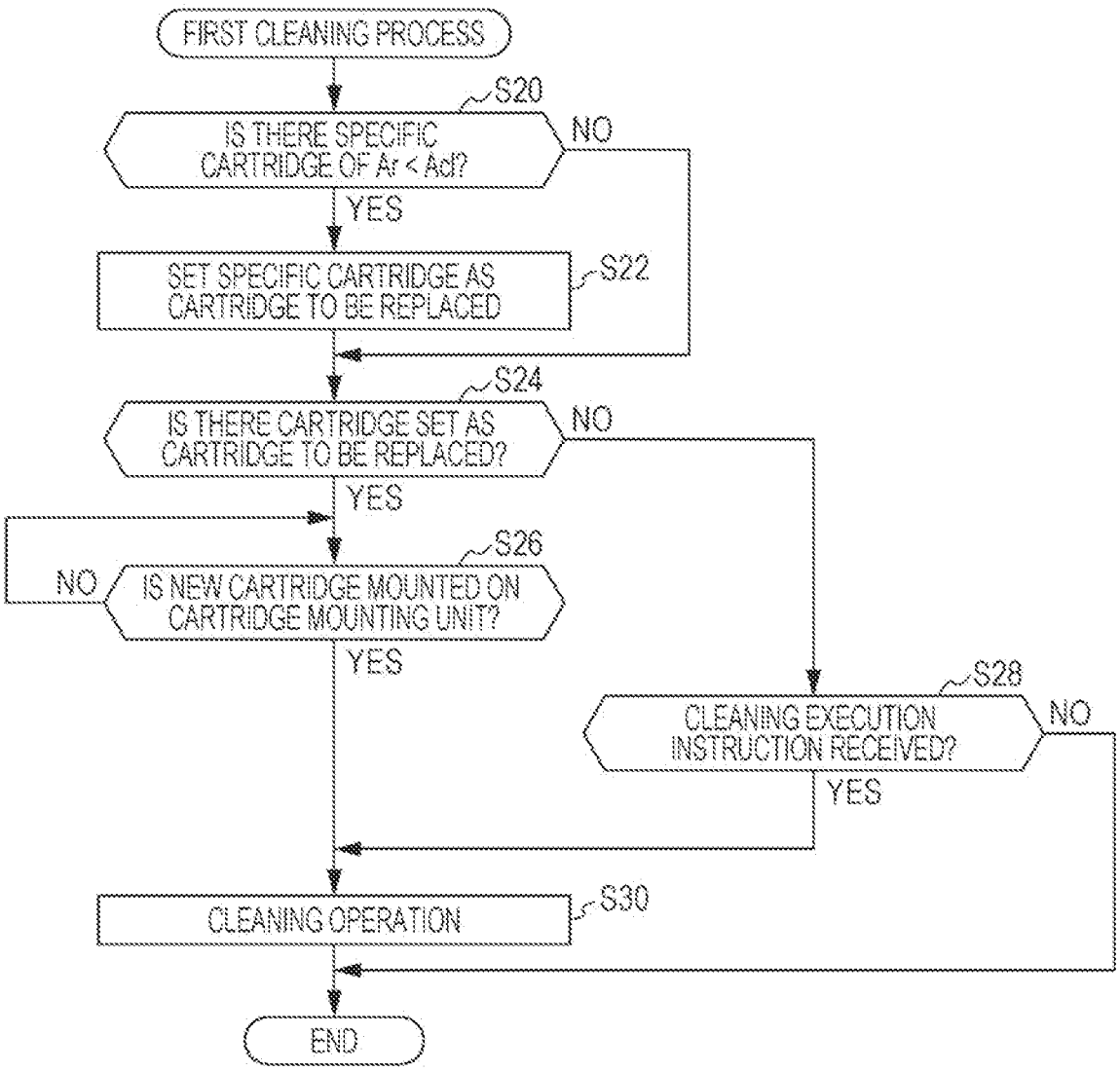
FIG. 5 is a flowchart of a first cleaning process.

FIG. 4 is a flowchart of the end process. FIG. 5 is a flowchart of the first cleaning process. The cleaning execution unit 44 starts the end process shown in FIG. 4, for example, when printing by the printing operation unit 42 is completed. In step S10, using the liquid remaining amount Ar acquired by the remaining amount acquisition unit 43, it is detected whether there is a cartridge in which the liquid remaining amount Ar is less than a predetermined end reference remaining amount Ae among the plurality of cartridges 20. Here, the end reference remaining amount Ae is an example of the reference remaining amount. In step S10, when it is determined that there is an end cartridge in which the liquid remaining amount Ar is less than the predetermined end reference remaining amount Ae among the plurality of cartridges 20, the end condition as the cleaning condition is satisfied. As a result, the cleaning execution unit 44 sets the end cartridge as a cartridge to be replaced in step S12, and notifies the user that the cartridge 20 is required to be replaced. Specifically, the cleaning execution unit 44 displays a message such as "replace the cartridge" in a display unit, such as a liquid crystal display (not shown), of the printing device 50 or a display unit of the PC 9. After the execution of step S12, the process proceeds to step S14. In step S10, when it is determined that there is no end cartridge in which the liquid remaining amount Ar is less than the predetermined end reference remaining amount Ae among the plurality of cartridges, the process proceeds to step S14. In step S14, the first cleaning process is executed.

In the first cleaning process shown in FIG. 5, the determination process is executed in step S20. In step S20, it is determined whether there is a specific cartridge whose liquid remaining amount Ar is less than a cleaning reference remaining amount Acl in the cartridge 20 other than the end cartridge among the plurality of cartridges 20. Here, the cleaning reference remaining amount Acl is a value greater than the end reference remaining amount Ae, and is a remaining amount when the liquid remaining amount Ar is expected to be less than the end reference remaining amount Ae when the cleaning operation is executed. That is, in step S20, the presence or absence of a specific cartridge when the liquid remaining amount Ar is equal to or greater than the predetermined end reference remaining amount Ae among the plurality of cartridges 20, and the liquid remaining amount Ar is less the end reference remaining amount Ae if the cleaning operation is executed is determined. When it is determined in step S20 that there is the specific cartridge, the specific cartridge is set as a cartridge to be replaced in step S22 as the setting process, the user is notified that the cartridge 20 is required to be replaced, and the process proceeds to step S24. When it is determined in step S20 that there is no specific cartridge, step S22 is skipped and the process proceeds to step S24.

In step S24, the presence or absence of the cartridge 20 set as a cartridge to be replaced, that is, the end cartridge or the specific cartridge is determined. When it is determined in step S24 that there is no end cartridge or specific cartridge, it is determined in step S28 whether the cleaning execution instruction is received. When it is determined in step S28 that the cleaning execution instruction is not received, it is not necessary to execute the cleaning operation, so that the processing routine ends. When it is determined in step S28 that the cleaning execution instruction is being received, the process proceeds to step S30. When it is determined in step S24 that there is an end cartridge or a specific cartridge, it is determined in step S26 whether a new cartridge is mounted on the cartridge mounting unit 59*a* according to the presence or absence of a signal from the carriage 59. When it is determined in step S26 that the new cartridge 20 is not mounted on the cartridge mounting unit 59*a*, the process is returned to step S26, and step S26 is repeatedly executed every predetermined time until it is determined that the new cartridge 20 is mounted. Here, the predetermined time is, for example, several seconds. When it is determined in step S26 that the new cartridge 20 is mounted on the cartridge mounting unit 59*a*, the process proceeds to step S30. In step S30, the cleaning operation is executed, and the subroutine ends. Returning to FIG. 4, when the first cleaning process in step S14 is completed, the processing routine ends.

The end process shown in FIG. 4 will be described with an example in which the liquid remaining amount Ar of the cartridge 20K containing black ink is less than the end reference remaining amount Ae, and the liquid remaining amount Ar of the cartridge 20C containing cyan ink is equal to or more than the end reference remaining amount Ae and is less the cleaning reference remaining amount Acl. In this case, in addition to the cartridge 20K set as a cartridge to be replaced in step S12, the cartridge 20C is set as a cartridge to be replaced in step S22 shown in FIG. 5 of the end process. After the cartridge 20K and the cartridge 20C set as cartridges to be replaced are removed from the cartridge mounting unit 59*a* and replaced with the new cartridges 20K and 20C mounted, the cleaning operation in step S30 is executed. As a result, the ink remaining in the cartridge 20C is collected in the state of being contained in the cartridge 20C without being stored in the waste liquid tank. Then, the ink remaining in the collected cartridge 20C can be recycled. Further, in step S12, since the cartridge 20K, which is an end cartridge, is set as a cartridge to be replaced, the cartridge 20K and the cartridge 20C are set as cartridges to be replaced at the same time. As a result, it is possible to reduce the downtime that occurs when control in which only one of the specific cartridge and the end cartridge is set as a cartridge to be replaced is performed. More specifically, for example, when only the cartridge 20K is set as a cartridge to be replaced, a cleaning operation is executed after the cartridge 20K is replaced, so that the cartridge 20C is an end cartridge and the cartridge 20C is set as a cartridge to be replaced. As a result, the cartridge 20C is replaced immediately after the cartridge 20K is replaced, so that the cartridge 20 is replaced and the cleaning operation is performed twice in a short period of time. This causes downtime due to replacement. Further, with the replacement of the cartridge 20, the new cartridge 20 will be delivered twice. In this respect, in the present embodiment, since the cartridge 20K and the cartridge 20C are set as cartridges to be replaced at the same time, it is avoided that the cartridge 20 is replaced and the cleaning operation is performed twice in a short period of time, and downtime can be reduced, compared with the control under which only the end cartridge is set as a cartridge to be replaced. Further, it is possible to prevent the new cartridge 20 from being delivered twice, and the delivery frequency can be reduced.

Figure 6:
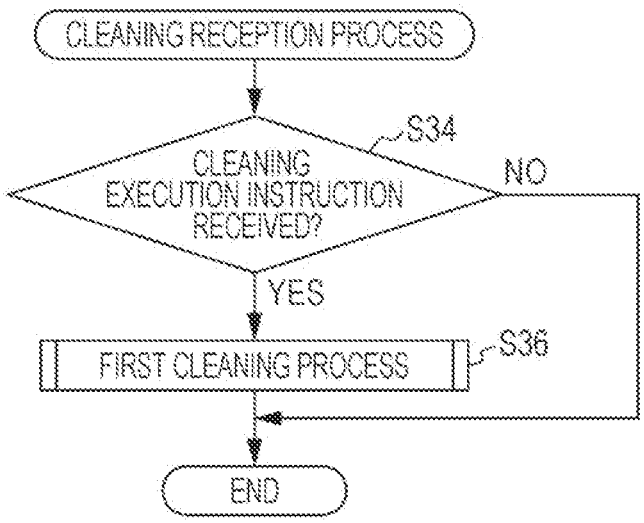
FIG. 6 is a flowchart of a cleaning reception process.

FIG. 6 is a flowchart of the cleaning reception process. The cleaning execution unit 44 executes the cleaning reception process shown in FIG. 6, for example, when the power of the printing device 50 is turned on. In step S34, it is determined whether the cleaning execution instruction is received. As described above, for example, when the ink is not sufficiently ejected from the nozzle 88 and good printing is not performed, the user inputs a cleaning execution instruction instructing the printing device 50 to execute the cleaning operation. Further, for example, the CPU 41 automatically determines whether ink is sufficiently ejected from the nozzle 88, that is, whether the nozzle clogging is present, and when it is determined that the nozzle clogging occurs, the cleaning execution instruction may be transmitted to the cleaning execution unit 44. When it is determined in step S34 that the cleaning execution instruction is received, since the instruction reception condition as the cleaning condition is satisfied, the first cleaning process shown in FIG. 5 is executed in step S36, and the present processing routine ends. That is, the process of step S36 and the first cleaning process of step S14 shown in FIGS. 4 and 5 have the same contents. In the first cleaning process executed in this process, even when it is determined in step S24 that there is no cartridge 20 set as a cartridge to be replaced, the cleaning operation according to step S30 is performed. This is because it is determined in step S28 that the cleaning execution instruction is being received. As in the end process, in this process, the specific cartridge, if any, is set as a cartridge to be replaced without performing the cleaning operation. As a result, it is possible to collect the specific cartridge in which the ink remains.

Figure 7:
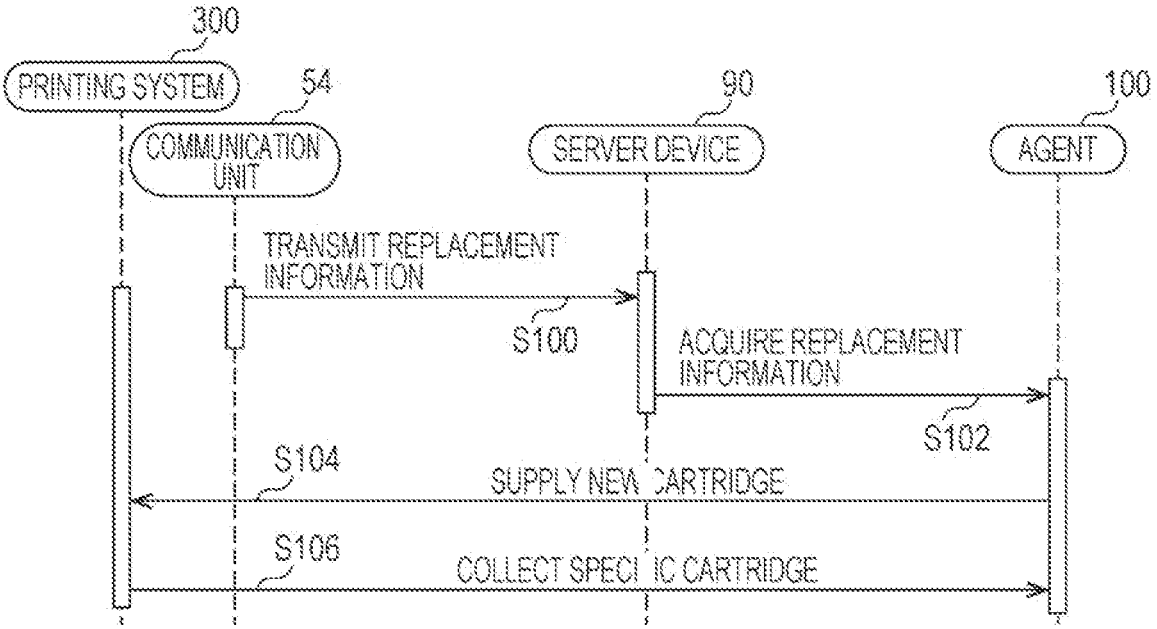
FIG. 7 is a cartridge collection and supply sequence diagram.

FIG. 7 is a collection and supply sequence diagram of the cartridge. When the cleaning execution unit 44 determines that there is the cartridge 20 set as a cartridge to be replaced in step S24 of the first cleaning process shown in FIG. 5, this sequence is started. In step S100, the communication unit 54 transmits, to the server device 90, replacement information indicating that the specific cartridge is set as a cartridge to be replaced in the server device 90. When there is an end cartridge, the replacement information includes information indicating that the end cartridge is set as a cartridge to be replaced. Further, the replacement information includes the color information of the ink of the cartridge 20 set as a cartridge to be replaced. When the replacement information is received by the server device 90, in step S102, the agent 100 acquires the replacement information. In step S104, when there is an end cartridge, the agent 100 supplies, to the printing system 300, a new cartridge 20 having the same color as the end cartridge and a new cartridge 20 having the same color as the specific cartridge based on the replacement information. In addition, in step S106, when there is an end cartridge, the agent 100 collects the end cartridge and the specific cartridge from the printing system 300. As a result, the specific cartridge can be collected with the ink remaining in the cartridge. The ink remaining in the specific cartridge may be recycled when a new cartridge 20 is manufactured.

According to the first embodiment described above, in the first cleaning process, when it is determined in step S20 of FIG. 5 that there is a specific cartridge, the specific cartridge is set as a cartridge to be replaced before the cleaning operation in step S30 is executed. As a result, the specific cartridge can be collected with the reproducible ink remaining in the cartridge. Further, as shown in FIG. 4, when it is detected in step S10 of the end process that there is an end cartridge having less than the end reference remaining amount Ae, the end cartridge is set as a cartridge to be replaced in step S12. As a result, the end cartridge together with the specific cartridge can be set as a cartridge to be replaced. Further, when a new cartridge 20 is mounted on the cartridge mounting unit 59*a* in step S26 of the first cleaning process performed in step S14 of the end process, the cleaning operation is executed in step S30. As a result, when the specific cartridge and the end cartridge are each replaced with a new cartridge, the cleaning operation can be performed. Further, as shown in FIG. 6, when the cleaning execution instruction is received in step S34 of the cleaning reception process, the first cleaning process is executed in step S36. As a result, the first cleaning process can be executed when the cleaning execution instruction is received. Further, when a new cartridge 20 is mounted on the cartridge mounting unit 59*a* in step S26 of the first cleaning process performed in step S36 of the cleaning reception process, the cleaning operation is executed in step S30. As a result, when the specific cartridge is replaced with a new cartridge, the cleaning operation can be performed. Further, as shown in FIG. 7, when the cleaning execution unit 44 sets the specific cartridge as a cartridge to be replaced in step S100 of the collection and supply sequence of the cartridge 20, the communication unit 54 transmits the replacement information to the server device 90. As a result, the specific cartridge can be properly collected.

B. Second Embodiment

Figure 8:
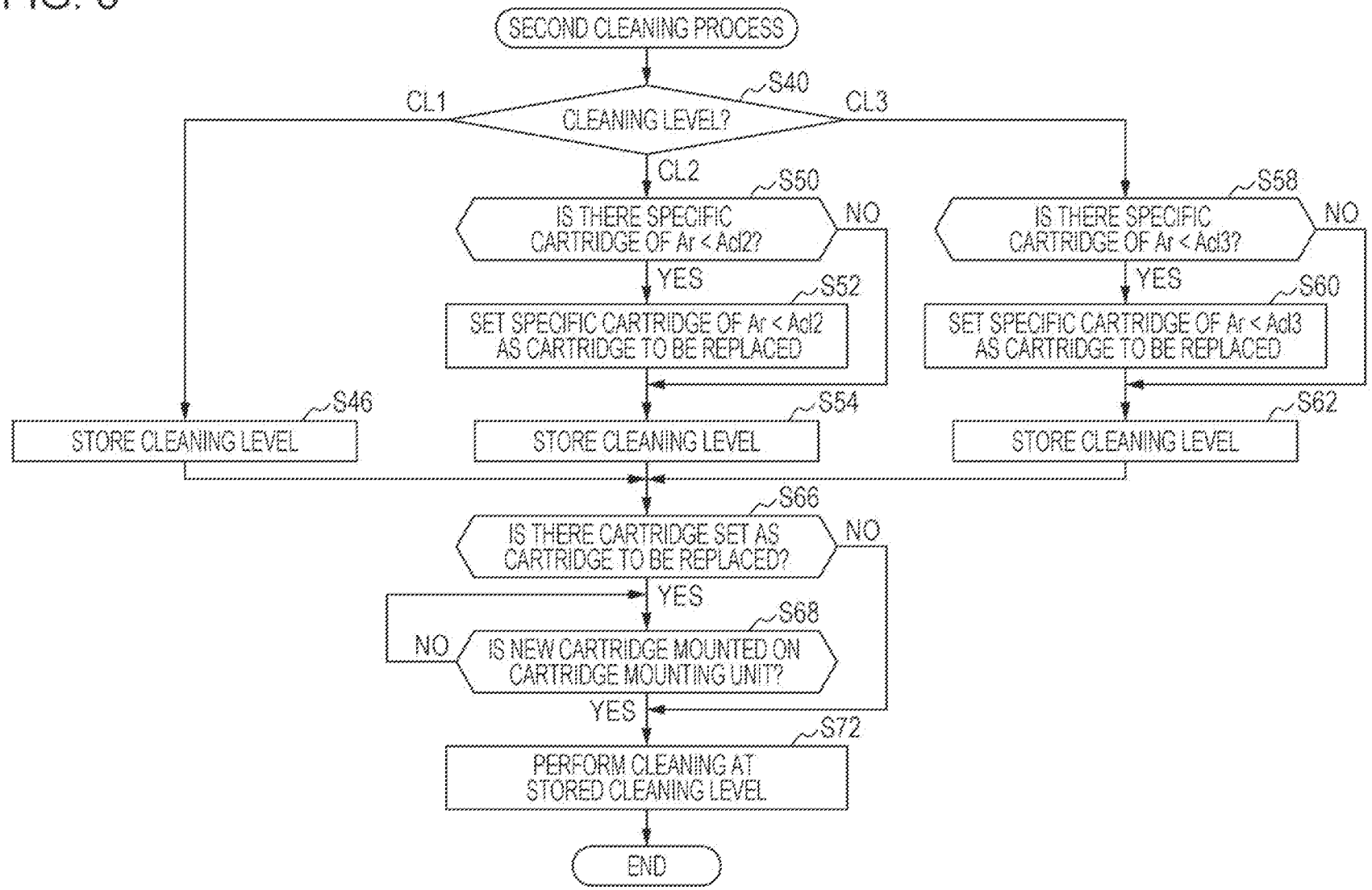
FIG. 8 is a flowchart of a second cleaning process according to the second embodiment.

The second cleaning process as the cleaning process according to the second embodiment executed by the printing device 50 will be described with reference to FIG. 8. As in the first embodiment, in the present embodiment, the end process and the cleaning reception process are executed and in step S14 of the end process, the first cleaning process is executed. However, unlike the first embodiment, in step S36 of the cleaning reception process, the second cleaning process instead of the first cleaning process is executed. In the present embodiment, the cleaning level, which is the strength of the cleaning operation, can be set to three levels, which is levels CL1, CL2, and CL3. At the levels CL1, CL2, and CL3, the rotation speed of the suction pump 34 is different. Of the three levels CL1, CL2, and CL3, at level CL1, the rotation speed of the suction pump 34 is the lowest, and the degree of suction is weak. On the other hand, of the three levels CL1, CL2, and CL3, at the level CL3, the rotation speed of the suction pump 34 is the highest, and the degree of suction is high. That is, when the cleaning operation is executed for the same time, the suction amount of the liquid is the largest at the level CL3. Specifically, the suction amount per unit time is adjusted to each level by adjusting the suction force by changing the rotation speed of the suction pump 34. For example, when the amount of ink ejected from the nozzle 88 at the time of printing is very small, that is, when the printed image is hardly formed, the suction amount is set to the level CL3. Then, for example, when the printed image is faint, the suction amount is set to the level CL1. In the present embodiment, the cleaning level is set when the user gives a cleaning execution instruction. As a result, the cleaning execution instruction includes any of a plurality of cleaning levels, the levels CL1, CL2, and CL3, as instruction contents. The cleaning operation executed in the end process is performed at the level CL1.

When the second cleaning process is started, it is determined in step S40 whether the cleaning level is the level CL1, CL2, or CL3. When the cleaning level is determined to be the level CL1 in step S40, the cleaning level is stored as the level CL1 in step S46, and the process proceeds to step S66. In the present embodiment, the cleaning execution instruction is received only when the ink capable of executing the level CL1 remains in the cartridge 20. Therefore, the process of determining the presence/absence of the cartridge whose liquid remaining amount Ar is less than the amount at which the cleaning operation of the level CL1 can be executed is omitted.

When the cleaning level is determined to be the level CL2 in step S40, it is determined in step S50 whether there is a specific cartridge whose liquid remaining amount Ar is less than a second cleaning reference remaining amount Acl2. Here, the second cleaning reference remaining amount Acl2 is a remaining amount that is greater than the end reference remaining amount Ae and when the liquid remaining amount Ar is expected to be less than the end reference remaining amount Ae when the cleaning operation of the level CL2 is executed. When it is determined in step S50 as the determination process that there is no specific cartridge whose liquid remaining amount Ar is less than the second cleaning reference remaining amount Acl2, the process proceeds to step S54. In step S50, when it is determined that there is a specific cartridge whose liquid remaining amount Ar is less than the second cleaning reference remaining amount Acl2, the specific cartridge is set as a cartridge to be replaced in step S52 as the setting process, the user notified that the cartridge 20 is required to be replaced, the cleaning level is stored as the level CL2 in step S54, and the process proceeds to step S66.

When the cleaning level is determined to be the level CL3 in step S40, it is determined in step S58 as the determination process whether there is a specific cartridge whose liquid remaining amount Ar is less than a third cleaning reference remaining amount Acl3. Here, the third cleaning reference remaining amount Acl3 is the remaining amount that is greater than the end reference remaining amount Ae and when the liquid remaining amount Ar is expected to be less than the end reference remaining amount Ae when the cleaning operation of the level CL3 is executed. When it is determined in step S58 that there is no specific cartridge whose liquid remaining amount Ar is less than the third cleaning reference remaining amount Acl3, the process proceeds to step S62. In step S58, when it is determined that there is a specific cartridge whose liquid remaining amount Ar is less than the third cleaning reference remaining amount Acl3, the specific cartridge is set as a cartridge to be replaced in step S60 as the setting process, the user is notified that the cartridge 20 is required to be replaced, the cleaning level is stored as the level CL3 in step S62, and the process proceeds to step S66.

In step S66, the presence or absence of the cartridge 20 set as a cartridge to be replaced, that is, the specific cartridge, is determined. When it is determined in step S66 that there is no specific cartridge, the process proceeds to step S72. When it is determined in step S66 that there is a specific cartridge, it is determined in step S68 whether a new cartridge 20 is mounted on the cartridge mounting unit 59*a* according to the presence or absence of a signal from the carriage 59. When it is determined in step S68 that the new cartridge 20 is not mounted on the cartridge mounting unit 59*a*, the process is returned to step S68, and step S68 is repeatedly executed every predetermined time until it is determined that the new cartridge 20 is mounted. When it is determined in step S68 that the new cartridge 20 is mounted on the cartridge mounting unit 59*a*, the process proceeds to step S72. In step S72, the cleaning operation is executed at the stored cleaning level, and the processing routine ends.

As in the first embodiment, according to the second embodiment described above, when it is determined in any of steps S50 and S58 that there is a specific cartridge, the specific cartridge is set as a cartridge to be replaced in step S52 and step S60 before the cleaning operation in step S72 is executed. As a result, the specific cartridge can be collected with the reproducible ink remaining in the cartridge. Further, in steps S46, S54, and S62, the cleaning level included in the cleaning execution instruction is stored, and in step S72, the cleaning operation is performed at the stored cleaning level, so that the cleaning operation can be executed at the cleaning level included in the cleaning execution instruction.

C. Other Embodiments

C1. Another Embodiment 1

In the description of the first embodiment, the cleaning execution unit 44 starts the end process when printing by the printing operation unit 42 is completed, but the start time of the end process is not limited to the printing end time. For example, this may be executed when the power of the printing device 50 is turned on, when the amount of ink in the cartridge 20 is less than the end reference remaining amount Ae during the printing operation, or the like.

C2. Another Embodiment 2

In the second embodiment, the cleaning execution instruction is given by the user. When the printing device 50 has a function of setting the cleaning level according to the printing situation without according to the input by the user, the cleaning level may be set by the printing device 50. Specifically, the function of setting the cleaning level is implemented by the printing device 50 including a detection unit that detects the amount of ink ejected from the nozzle 88 and a setting unit that sets the cleaning level based on the amount of ejected ink detected by the detection unit. The function of the detection unit is implemented by, for example, a photo implanter that detects the ejected ink.

C3. Another Embodiment 3

In the second cleaning process according to the second embodiment, when the cleaning level is determined to be the level CL1 in step S40, the determination process of determining whether there is a specific cartridge whose liquid remaining amount Ar is less than the liquid remaining amount at which the cleaning operation of the level CL1 is performed is not executed. However, as in the case where the cleaning level is determined to be the level CL2 in step S40, a determination step of determining whether there is a specific cartridge whose liquid remaining amount Ar is less than the liquid remaining amount at which the cleaning operation of the level CL1 is performed and a processing step of setting the specific cartridge as a cartridge to be replaced when there is the specific cartridge may be provided. Further, in the second embodiment, the cleaning operation executed in the end process is performed at the level CL1. When there is the cleaning operation, at the level CL2 or the level CL3, that is not executed and is put on hold before the end process is executed, instead of the cleaning operation at the level CL1, the cleaning operation, at the level CL2 or the level CL3, that is put on hold may be executed. For example, when the cartridge 20 is replaced after receiving the cleaning execution instruction, the cleaning operation may be put on hold.

C4. Another Embodiment 4

The present disclosure is not limited to the ink jet printer and the cartridge thereof, but can be applied to a printing device on which the cartridge containing a liquid other than ink are detachably mounted. For example, the present disclosure can be applied to the following printing devices and injection devices as printing devices.

(1) Image printing device such as facsimile equipment (2) Color material printing device used for manufacturing a color filter for image display devices such as a liquid crystal display.

(3) Electrode material printing device used for formation of the electrode of an organic electro luminescence (EL) display, a field emission display (FED), or the like (4) An Injection device that injects a liquid containing bioorganic substances used in biochip manufacturing (5) A sample injection device as a precision pipette (6) A lubricating oil injection device (7) A resin liquid injection device (8) A liquid injection device that injects lubricating oil pinpointly to a precision machine such as a watch and a camera.

(9) A liquid injection device that injects a transparent resin liquid such as an ultraviolet curable resin liquid onto a substrate to form a microhemispherical lens or the like used for an optical communication element or the like.

(10) A liquid injection device that injects an acidic or alkaline etching solution to etch a substrate or the like.

(11) A liquid injection device including a liquid injection head that ejects minute amounts of droplets of other liquids.

The term "droplet" refers to the state of the liquid discharged from the liquid injection device, and includes those having a granular, tear-like, or thread-like tail. Further, the term "liquid" as used herein may be any material that can be injected by the liquid injection device. For example, the "liquid" may be a material in a state when the substance is in a liquid phase. The "Liquid" includes liquid materials having high or low viscosity and liquid materials such as sol, gel water, other inorganic solvents, organic solvents, solutions, liquid resins, and liquid metals (metal melts). Further, the "liquid" includes not only a liquid as one state of a substance but also a liquid in which particles of a functional material made of a solid such as a pigment or metal particles are dissolved, dispersed or mixed in a solvent. Further, representative examples of the liquid include ink and liquid crystal as described in the above embodiment. Here, the ink includes various liquid compositions such as general water-based ink and oil-based ink, gel ink, and hot-melt ink.

D. Other Aspects

The present disclosure is not limited to the above-described embodiment, and can be implemented in various aspects without departing from the spirit thereof. For example, the present disclosure can also be implemented in the following aspects. Since the technical features of the embodiments corresponding to the technical features in the aspects described below are provided to solve some or all of the problems in the present disclosure or achieve some or all of the effects in the present disclosure, the technical features can be appropriately replaced or combined. Further, unless the technical features are described as essential items in the specification, the technical features may be appropriately deleted.

(1) According to the first aspect of the present disclosure, a printing device is provided. The printing device includes a cartridge mounting unit that allows a plurality of cartridges to be attached and detached, an ejection head including a plurality of nozzles configured to eject a liquid stored in each of the plurality of cartridges, and a controller, wherein a predetermined flat-rate usage fee is applied to the printing device regardless of the number of times the cartridges are replaced, wherein the controller includes a cleaning execution unit that executes a cleaning process including a cleaning operation of sucking and flowing out the liquid from the nozzles for all of the plurality of cartridges when a predetermined cleaning condition is satisfied and a remaining amount acquisition unit that acquires a liquid remaining amount of each of the plurality of cartridges, and wherein the cleaning process includes a determination process of determining presence or absence of a specific cartridge, among the plurality of cartridges, in which the liquid remaining amount that is equal to or greater than a predetermined reference remaining amount, and the liquid remaining amount is expected to be less than the reference remaining amount when the cleaning operation is executed, the determination process being executed before the cleaning operation is executed, and a setting process of setting the specific cartridge as a cartridge to be replaced before executing the cleaning operation when it is determined by the determination process that the specific cartridge is present. According to this aspect, since the specific cartridge is set as a cartridge to be replaced before the cleaning operation is executed, the specific cartridge can be collected with the reproducible liquid remaining in the specific cartridge.

(2) In the above aspect, the cleaning execution unit may execute the cleaning process when an end condition as the cleaning condition that the remaining amount acquisition unit determines that the liquid remaining amount in at least one of the plurality of cartridges is less than the reference remaining amount is satisfied, and wherein in a case where the cleaning process is executed when the end condition is satisfied, the setting process may further include setting, as a cartridge to be replaced, an end cartridge which is the cartridge the liquid remaining amount of which is determined to be less than the reference remaining amount. According to this aspect, when it is determined that the liquid remaining amount in at least one of the plurality of cartridges is less than the reference remaining amount, a cleaning process can be executed and the end cartridge can be set as a cartridge to be replaced.

(3) In the above aspect, the cleaning execution unit may execute the cleaning operation when the end cartridge, and the specific cartridge, if any, are each replaced with a new cartridge and mounted on the cartridge mounting unit. According to this aspect, when the specific cartridge and the end cartridge are each replaced with a new cartridge, the cleaning operation can be performed.

(4) In the above aspect, the cleaning execution unit may execute the cleaning process when an instruction reception condition as the cleaning condition that a cleaning execution instruction which is an instruction to execute the cleaning operation is received is satisfied. According to this aspect, the cleaning process can be executed when the cleaning execution instruction is received.

(5) In the above aspect, the cleaning execution unit may execute the cleaning operation when the specific cartridge is replaced with a new cartridge and mounted on the cartridge mounting unit. According to this aspect, when the specific cartridge is replaced with a new cartridge, the cleaning operation can be performed.

(6) In the above aspect, the cleaning execution instruction includes, as an instruction content, any of a plurality of cleaning levels in which suction amounts of the liquid used in the cleaning operation are different from each other, and wherein the cleaning execution unit executes the cleaning operation at a cleaning level same as any of the plurality of cleaning levels included in the cleaning execution instruction. According to this aspect, the cleaning operation can be executed at the cleaning level included in the cleaning execution instruction.

(7) According to the second aspect of the present disclosure, a printing system is provided. The printing system includes the printing device of the first aspect and a server device that communicates with the printing device, wherein the printing device further includes a communication unit that communicates with the server device, and wherein the communication unit transmits, to the server device, replacement information indicating that the specific cartridge is set as a cartridge to be replaced when the cleaning execution unit sets the specific cartridge as a cartridge to be replaced. According to this aspect, the specific cartridge can be appropriately collected.

The present disclosure can also be implemented in various aspects other than the above. For example, it can be implemented in the aspect of an information processing system, a computer program that implements any of the above aspects, a non-temporary recording medium on which the computer program is recorded, and the like.

The plurality of components of each aspect of the present disclosure described above is not all essential and may be used to solve some or all of the problems described above, or part or all of the effects described herein. In order to achieve the above, it is possible to change, delete, replace some of the plurality of components with new other components, and partially delete the limited contents, as appropriate. Also, in order to solve some or all of the above-mentioned problems, or to achieve some or all of the effects described herein, some or all of the technical features included in one aspect of the above-mentioned present disclosure may be an independent aspect of the present disclosure in combination with some or all of the technical features contained in the other aspects of the present disclosure described above to aspect.

What is claimed is:

1. A printing device comprising:

a cartridge mounting unit that allows a plurality of cartridges to be attached and detached;

an ejection head including a plurality of nozzles configured to eject a liquid stored in each of the plurality of cartridges; and a controller, wherein a predetermined flat-rate usage fee is applied to the printing device regardless of the number of times the cartridge is replaced, wherein the controller includes a cleaning execution unit that executes a cleaning process including a cleaning operation of sucking and flowing out the liquid from the nozzles for all of the plurality of cartridges when a predetermined cleaning condition is satisfied and a remaining amount acquisition unit that acquires a liquid remaining amount of each of the plurality of cartridges, and wherein the cleaning process includes a determination process of determining presence or absence of a specific cartridge, among the plurality of cartridges, in which the liquid remaining amount that is equal to or greater than a predetermined reference remaining amount, and the liquid remaining amount is expected to be less than the reference remaining amount when the cleaning operation is executed, the determination process being executed before the cleaning operation is executed, and a setting process of setting the specific cartridge as a cartridge to be replaced before executing the cleaning operation when it is determined by the determination process that the specific cartridge is present.

2. The printing device according to claim 1, wherein the cleaning execution unit executes the cleaning process when an end condition as the cleaning condition that the remaining amount acquisition unit determines that the liquid remaining amount in at least one of the plurality of cartridges is less than the reference remaining amount is satisfied, and wherein in a case where the cleaning process is executed when the end condition is satisfied the setting process includes further setting, as a cartridge to be replaced, an end cartridge which is the cartridge the liquid remaining amount of which is determined to be less than the reference remaining amount.

3. The printing device according to claim 2, wherein the cleaning execution unit executes the cleaning operation when the end cartridge, and the specific cartridge, if any, are each replaced with a new cartridge and mounted on the cartridge mounting unit.

4. The printing device according to claim 1, wherein the cleaning execution unit executes the cleaning process when an instruction reception condition as the cleaning condition that a cleaning execution instruction which is an instruction to execute the cleaning operation is received is satisfied.

5. The printing device according to claim 4, wherein the cleaning execution unit executes the cleaning operation when the specific cartridge is replaced with a new cartridge and mounted on the cartridge mounting unit.

6. The printing device according to claim 4, wherein the cleaning execution instruction includes, as an instruction content, any of a plurality of cleaning levels in which suction amounts of the liquid used in the cleaning operation are different from each other, and wherein the cleaning execution unit executes the cleaning operation at a cleaning level same as any of the plurality of cleaning levels included in the cleaning execution instruction.

7. A printing system comprising:

the printing device according to claim 1; and a server device that communicates with the printing device, wherein the printing device further includes a communication unit that communicates with the server device, and wherein the communication unit transmits, to the server device, replacement information indicating that the specific cartridge is set as a cartridge to be replaced when the cleaning execution unit sets the specific cartridge as a cartridge to be replaced.

* * * * *